US005501492A

United States Patent [19]

Kajuch

[11] Patent Number: 5,501,492

[45] Date of Patent: Mar. 26, 1996

[54] DEADBOLT WITH INFINITELY ADJUSTABLE BACKSET

[75] Inventor: Pete Kajuch, Brookfield, Wis.

[73] Assignee: Master Lock Company, Milwaukee, Wis.

[21] Appl. No.: 225,744

[22] Filed: Apr. 11, 1994

[51] Int. Cl.[6] ..... E05C 19/00

[52] U.S. Cl. ..... 292/1.5; 292/337; 292/DIG. 60

[58] Field of Search ..... 292/167, 169.14, 292/169, 1.5, 337, DIG. 60

[56] References Cited

U.S. PATENT DOCUMENTS

| | | | |
|---|---|---|---|
| 326,258 | 9/1885 | Woodrich et al. | 292/167 |
| 4,372,594 | 2/1983 | Gater | 292/1.5 |
| 4,772,055 | 9/1988 | Fang | 292/1.5 |
| 4,902,057 | 2/1990 | Ching | 292/1.5 X |
| 4,974,884 | 12/1990 | Dietrich | 292/335 X |
| 5,152,558 | 10/1992 | Smith et al. | 292/1.5 |

*Primary Examiner*—Rodney M. Lindsey
*Attorney, Agent, or Firm*—Dorn, McEachran, Jambor & Keating

[57] ABSTRACT

A door latch has a case and a bolt movable within the case between an extended position in which the bolt extends forwardly of the case and a retracted position in which the bolt is positioned within the case. A swivel is mounted in the case for turning movement and a link connects the swivel and the bolt whereby turning of the swivel moves the bolt between the extended and retracted positions. The swivel is movable relative to the forward end of the case for adjusting backset to any distance between defined backset adjustment limits. The bolt, link and case have cooperating portions thereof which hold the bolt in a fully extended position, resisting inward movement thereof except by turning of the swivel, at either limit of backset adjustment and at any backset adjustment position therebetween.

22 Claims, 3 Drawing Sheets

DEADBOLT WITH INFINITELY ADJUSTABLE BACKSET

THE FIELD OF THE INVENTION

The present invention relates to an adjustable backset deadbolt and more specifically to a deadbolt in which backset has essentially infinite adjustment between the defined limits of maximum and minimum backset. The concept of an adjustable backset deadbolt or deadlatch was initially derived to avoid the necessity of stocking locks with two different backset distances. In the prior art adjustable backset locks either both the casing and the bolt were adjustable between two different backset distances or in some instances the casing would be adjustable and in others the bolt would be adjustable. But in any prior art device the lock must be in one of the two backset positions before it would function correctly. The present invention concerns a lock which provides standard bolt operation and function at any backset position whether it be a minimum backset distance which may be 2⅜", a maximum backset distance which may be 2¾", or at any adjustable position between these two limits.

SUMMARY OF THE INVENTION

The present invention relates to an adjustable backset deadbolt and specifically to such a lock in which there may be infinite backset adjustment between defined limits.

Another purpose of the invention is to provide an adjustable backset deadbolt in which only the casing is moved in adjusting backset and the internal connection between the swivel and the bolt is never disengaged during backset adjustment.

Another purpose of the invention is to provide a simply constructed reliable infinitely adjustable backset deadbolt.

Another purpose of the invention is an adjustable backset deadbolt which does not require accuracy in door preparation.

Another purpose of the invention is to provide an adjustable backset deadbolt or deadlatch in which there is a unique cooperation between the lock casing, the lock bolt, the swivel and connecting link to provide infinite adjustment between the conventional limits of backset adjustment.

Another purpose of the invention is to provide a latch of the type described in which the bolt is fully functional at an infinite number of backset positions.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
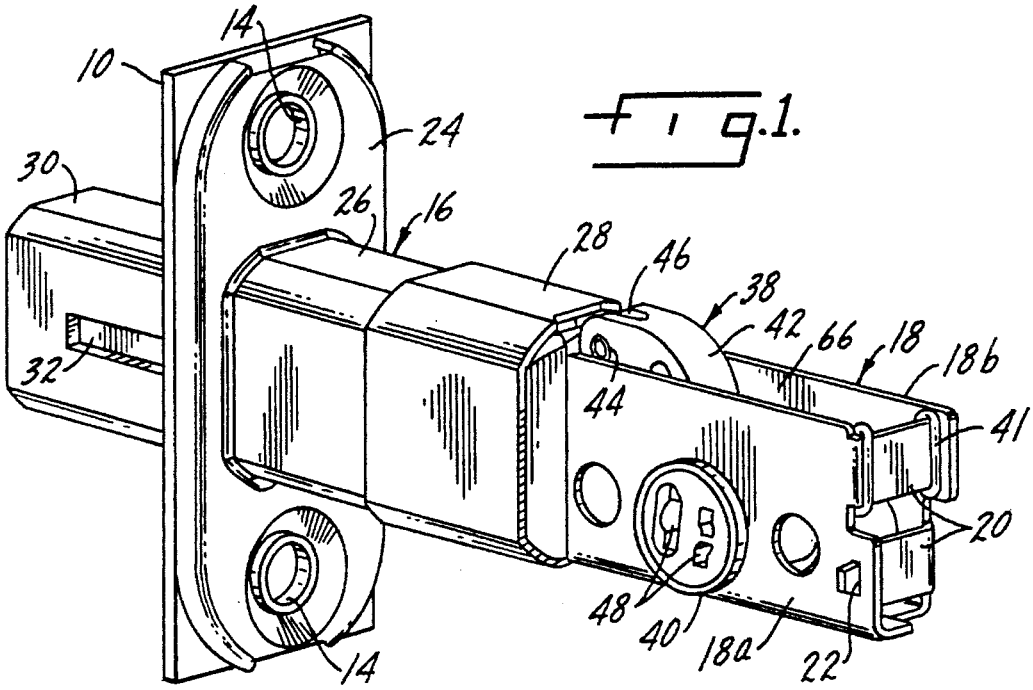
FIG. 1 is a perspective of the deadbolt assembly as viewed from the left rear.

Although the present invention will be described in connection with a deadbolt, the disclosed principles are equally applicable to a deadlatch. It is known in the art to have adjustable backset deadbolts and conventionally these devices are adjustable between backset distances of 2⅜" and 2¾". Most adjustable backset latches require adjustment of both the latch casing and the latch bolt. Often the internal mechanism which connects the swivel with the bolt must be disengaged before there can be backset adjustment. The present invention provides adjustable backset between the conventional limits but provides a latch which is fully functional at any backset distance between those limits. The bolt is not disengaged from the swivel during backset adjustment. It is only necessary to move the telescoping front and rear cases to provide backset adjustment.

In the drawings, the face plate for the latch, which will be mounted at the front of the door frame, is indicated at 10 and has a bolt hole 12 and fastener openings 14. The case assembly includes a front case 16 and a rear case 18 with the rear case 18 being constructed of case halves **18*a* and 18*b* which are held together by tabs 20 which will pass through aligned openings 22** in the case halves and then be suitably staked.

The front case 16 includes a front plate 24, a first case portion 26 which may be integral with or joined to the front plate 24, and a second case portion 28 which has a slightly greater cross section than the first case portion 26. There is an outwardly flared junction between the front case portions 26 and 28.

Figure 7:
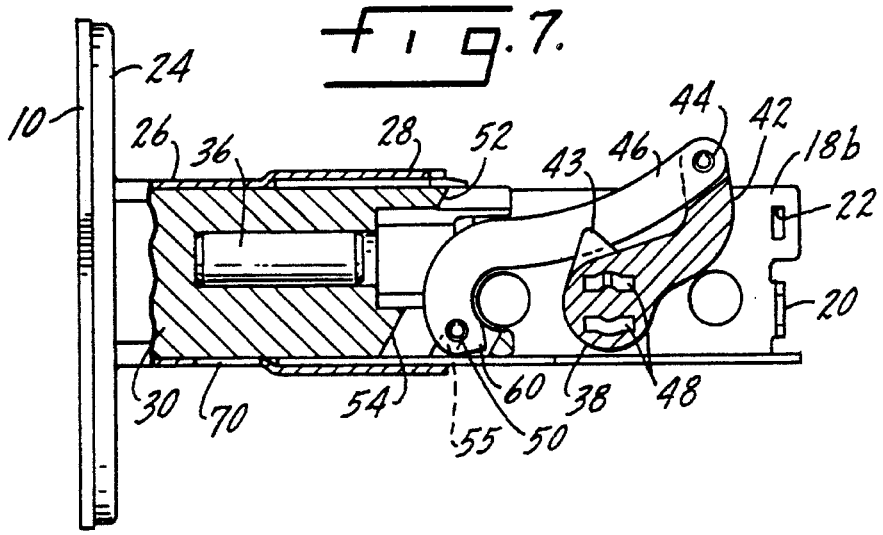
FIG. 7 is a section showing the assembly of FIG. 6 in a retracted position.
Figure 9:
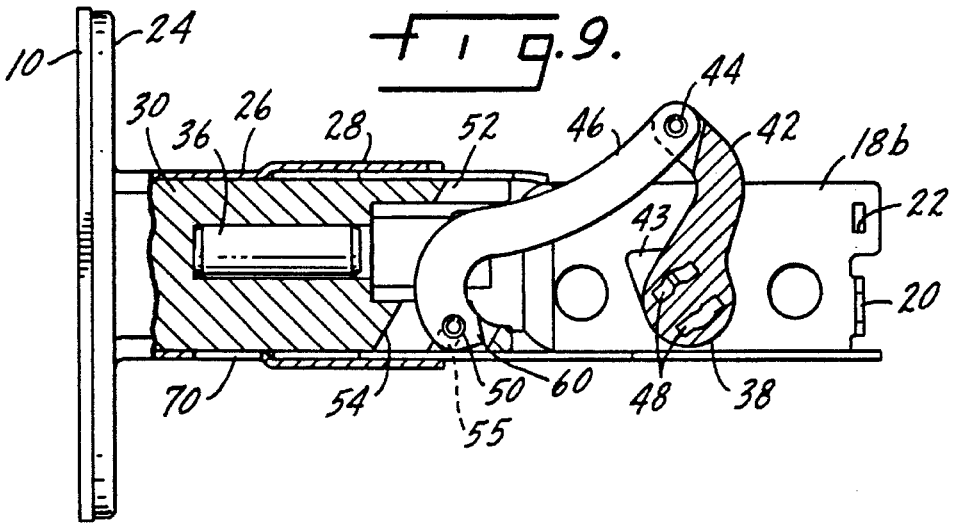
FIG. 9 is the bolt assembly of FIG. 8 in a retracted position.

Movable within the case assembly is a bolt which in the fully extended position will project a predetermined distance outwardly from face plate 10 and in the retracted position of FIGS. 7 and 9 will be fully within the case assembly. The bolt 30 has a longitudinally extending groove 32 along both sides with the ends of the groove defining the limits of bolt movement. The front case portion 26 may have an inwardly directed projection 34 which rides in one groove 32 and thus limits the length of inward and outward bolt movement. The bolt 30 may have a hardened rotatable pin 36, as is conventional in deadbolts, with the pin providing protection against destruction of the bolt when it is in the fully extended position. A person trying to saw through the bolt to disengage the latch will find it impossible to do so because of the rotatable hardened pin 36.

A swivel 38 is rotatably mounted in journals 40 in the rear case 18 for turning movement. As is known in the art, backset is the distance between the axis of rotation of the swivel 38 and the front of the latch as defined by the face plate 10. The swivel 38 has an arm 42 which is pivotally connected by a pin 44 to a link 46. Turning or rotational movement of the swivel, by the use of a key in the keyhole 48 of the swivel, will cause the link 46 to move between the extended and retracted positions illustrated in FIGS. 6 and 8 and FIGS. 7 and 9. Spring 41 holds the swivel by friction in any given position to insure deadlocking when the bolt is extended and to maintain retracted bolt position when the door is open. The forward end of link 46 is connected by a pin 50 to the bolt 30. Bolt 30 has an open face slot 52 in the top which allows for movement of the link 46 relative to the bolt and the bolt 30 has a closed face slot 54, more particularly shown in FIGS. 3 and 4 which forms a portion of the mechanism connecting the link 46 and the bolt 30.

Figure 4:
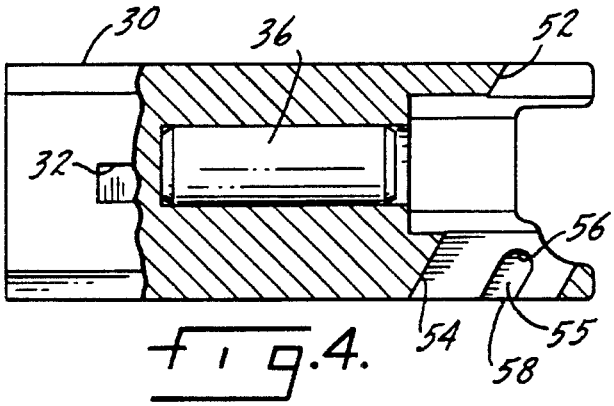
FIG. 4 is a partial axial section through the bolt of FIG. 3.
Figure 5:
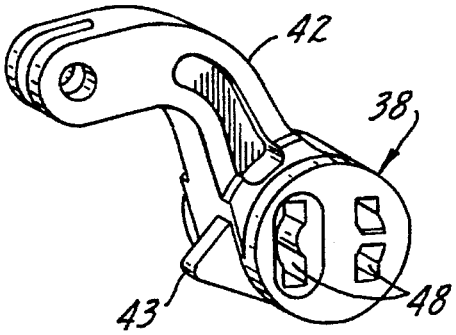
FIG. 5 is a perspective of the swivel as viewed from the front left.
Figures 2, 3:
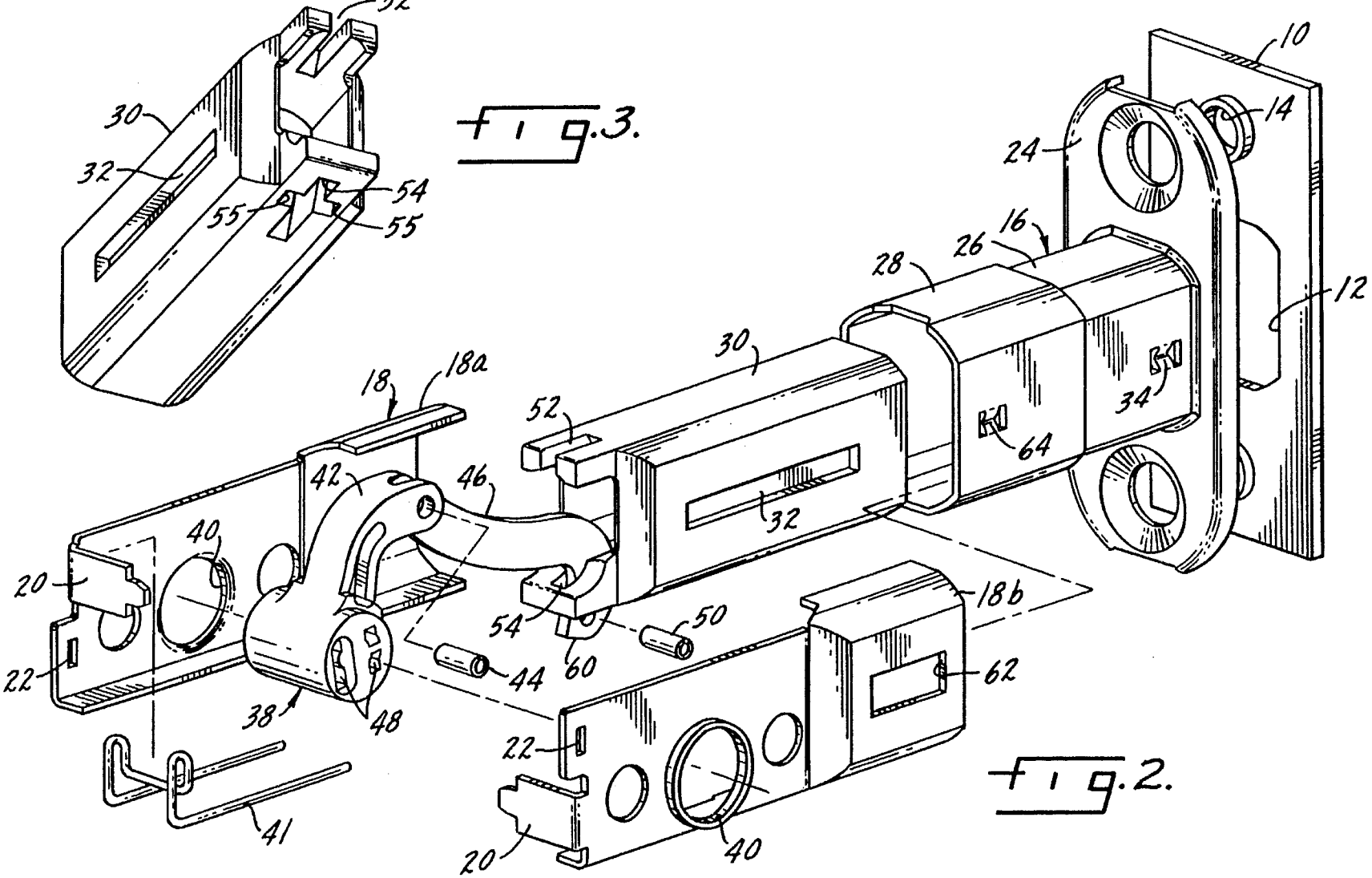
FIG. 2 is an exploded perspective of the deadbolt assembly as viewed from the right rear.
FIG. 3 is an underside perspective of the bolt as viewed from the left rear.

As seen particularly in FIGS. 3 and 4, the slot 54, in which the link 46 rides during movement of the swivel, has a pair of laterally extending grooves 55 in which the pin 50 rides during movement of the swivel. The grooves 55 have a closed end 56 on which the connecting pin pivots to retract the bolt, and an open end 58 which permits assembly and is later closed by the bottom surface of front case 16 and the bottom surfaces of rear cases 18*a* and 18*b*. The length of the slanted grooves 55 permits a degree of translational movement of the end 60 of link 46 which carries pin 50.

Backset is adjusted by moving the telescopic rear case 18 relative to the front case 16. The length of backset movement is defined by a slotted opening 62 in one side of the rear case 18 and a projection 64 extending into the interior of the front case portion 28. The rear case 18 may move between the limits defined by the slot 62 and the projection which define the extent of backset adjustment.

Figure 8:
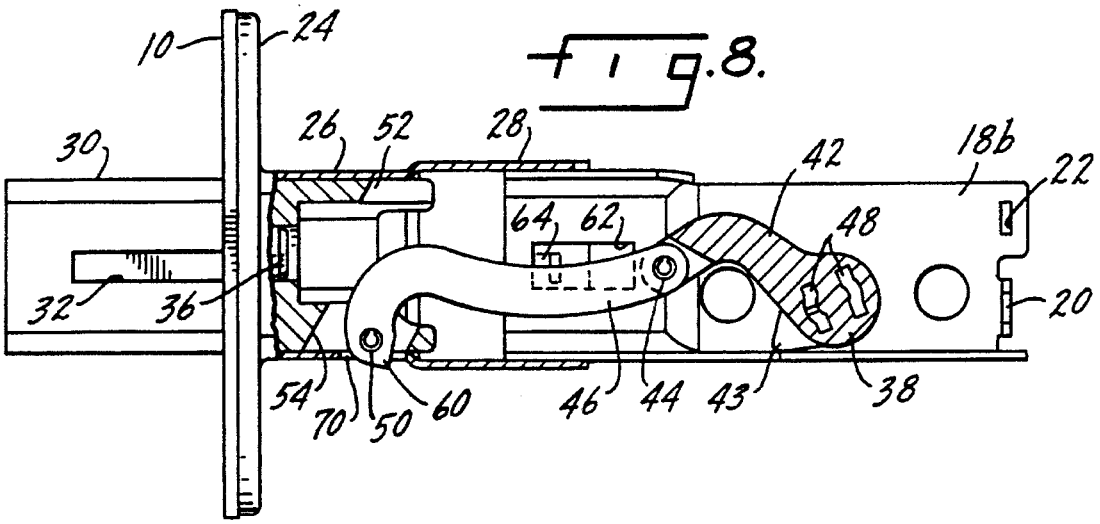
FIG. 8 is a section showing the assembly of FIG. 6 in an extended position for a 2¾" backset.

FIGS. 8 and 9 illustrate the deadbolt in a 2¾" backset position. FIG. 9 shows the latch in the retracted position and FIG. 8 shows the latch in a position in which the deadbolt is fully extended. Note that in FIG. 9 the link 46 and the arm 42 of the swivel extend upwardly through opening 66 in rear case 18. Referring to FIGS. 4 and 9, when the swivel is turned in a counterclockwise direction, link 46 pivots about arm 42 of the swivel and moves the bolt in a forward direction. Pin 50 will slide within groove 55 of the bolt and the forward portion of pin 50 will contact a wall in the bolt groove 55 to cause forward movement of the bolt. When the bolt has reached the fully extended position of FIG. 8, the portion 60 of link 46 will drop down through a front case slot 70 which is aligned with bolt slot 54. The extended ends of the pin 50 in the groove 55 are restrained by the lower wall of the front case 16 and this locks the bolt in the fully extended position and any force or pressure applied to the end of the bolt will not cause it to be retracted and the bolt will be held in the desired locked position. The cooperation between the groove 55 in the bolt, the end 60 of link 46, and the slot 70 in the front case are effective to hold the bolt in the fully extended position in all adjusted backset positions. The swivel 38 has a stop lobe 43 which contacts the lower wall of the rear case 18 and this prevents undue locking pressure.

To retract the bolt, the swivel is turned in a clockwise direction and its arm rotates in a clockwise direction. The link 46 will initially move up and out of slot 70 in the front case 16 and will then pivot relative to the bolt as pin 50 slides within groove 55. Continued turning movement of the swivel causes the link 46 to drag the bolt from the fully extended position into the retracted position of FIG. 9. The swivel will rotate through an angle of approximately 77 degrees in moving the bolt between the extended and retracted positions.

Figure 6:
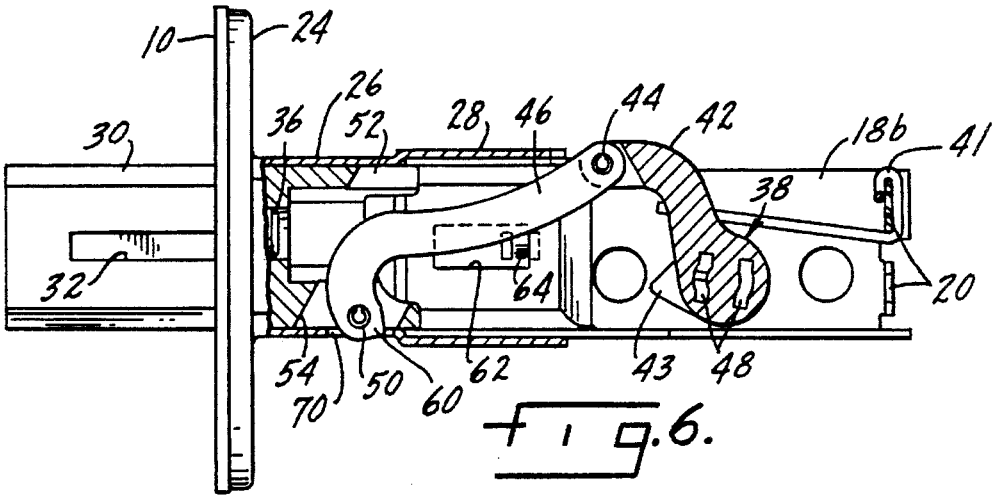
FIG. 6 is a section through the bolt assembly of FIG. 1 showing the extended position for a 2⅜" backset.

In order to adjust backset from the maximum extended position shown in FIGS. 8 and 9 to either the minimum position shown in FIGS. 6 and 7, or to any intermediate position therebetween, the rear case half 18 is telescoped into the front case half 16. The limit of this telescopic movement is defined by slot 62 and projection 64 and also by the forward end of rear case 18 when it reaches the outwardly flared junction of front case portion 28 and front case portion 26. In the 2⅜" backset position shown in FIGS. 6 and 7, the function of the bolt will be exactly as described when it was moved between the extended and retracted positions with maximum backset. The only difference is that the degree of swivel movement in this instance is approximately 81 degrees and the range of swivel movement is slightly clockwise of the range of swivel movement for maximum backset. Note that in the minimum backset distance there is the same cooperation between the end 60 of link 46, the slot 70 in the front case and the groove 55 in the bolt. The same is true if the latch is in any adjusted backset distance between maximum and minimum. The operation of the bolt in cooperation with the swivel is the same as described above and in any backset position the bolt functions in its complete and desired manner. The bolt will always be extended the same distance forward of front plate 10 regardless of backset and the bolt will be always held in that fully extended position by the cooperation between the casing, link and bolt described above.

Of importance in the invention is the ability to adjust backset between the conventional backset distances used in the building trades and to have backset infinitely adjustable between these limits. This eliminates the extreme accuracy required in door preparations for deadbolt installation when the backset distances must be either 2⅜" or 2¾. The mechanism for adjusting backset is simple and reliable. The telescopic front and rear cases are merely moved to the desired backset distance. The connection between the swivel and the bolt remains complete during backset adjustment and the link which connects these elements is capable of being fully operational and moving the bolt to the fully extended position in any backset position.

Whereas the preferred form of the invention has been shown and described herein, it should be realized that there may be many modifications, substitutions and alterations thereto.

The embodiments of the invention in which an exclusive property or privilege is claimed are defined as follows:

1. An adjustable backset door latch having a case, a bolt movable within said case between an extended position in which the bolt extends forwardly of said case and a retracted position in which said bolt is within said case, a swivel mounted in Said case for turning movement, means connecting said swivel and said bolt whereby turning of said swivel moves said bolt between said extended and retracted positions, said swivel being movable relative to a forward end of said casing for adjusting backset between defined backset adjustment limits and at all of infinite positions therebetween, and means for holding said bolt in a fully extended position, resisting inward movement thereof except by turning of said swivel, at either limit of backset adjustment and at all backset adjustment positions therebetween.

2. The adjustable backset door latch of claim 1 characterized in that the means connecting said swivel and said bolt include a link pivotally attached to said swivel and attached to said bolt for pivotal and translational movement relative thereto.

3. The adjustable backset door latch of claim 2 characterized in that said link has a portion thereof which extends outside of said bolt and into engagement with said case for holding said bolt in a fully extended position.

4. The adjustable backset door latch of claim 3 characterized in that the attachment of said bolt and link includes a slot in said bolt, a pin extending through said link and movable in said slot.

5. The adjustable backset door latch of claim 4 characterized in that said link is extendable through said bolt slot and into engagement with said case for holding said bolt in a fully extended position.

6. The adjustable backset door latch of claim 5 characterized in that said case has a slot therein for engaging said link.

7. The adjustable backset door latch of claim 6 characterized in that said case slot and bolt slot are in alignment when the bolt is extended in any adjusted backset position.

8. The adjustable backset door latch of claim 4 characterized in that said bolt slot is of a size and shape to provide for translational movement of said link relative to said bolt and pivotal movement of said link relative to said bolt.

9. The adjustable backset door latch of claim 1 characterized in that said case includes a front portion and a rear portion telescopically movable relative thereto, said swivel being mounted in said rear portion.

10. The adjustable backset door latch of claim 9 characterized by means for limiting telescopic movement between said front and rear case portions for defining the limits of backset adjustment.

11. The adjustable backset door latch of claim 10 characterized in that said limiting means includes a slot in said rear case portion and a projection on said front case portion movable in said slot.

12. The adjustable backset door latch of claim 1 characterized by means on said case limiting extending movement of said bolt.

13. The adjustable backset door latch of claim 12 characterized in that the means limiting extending movement of said bolt includes an inward projection on said case and a groove on the exterior of said bolt.

14. The adjustable backset door latch of claim 1 characterized in that said bolt has a hardened rotatable pin therein.

15. An adjustable backset door latch having a case assembly including a front case and a rear case telescopically movable relative thereto, a bolt movable in said case assembly between an extended position in which the bolt extends a determined distance forwardly of said front case and a retracted position in which said bolt is within said case assembly, a swivel mounted in said rear case for turning movement, a link connecting said swivel and bolt whereby turning movement of said swivel moves said bolt between said extended and retracted positions, means limiting relative movement of said front and rear cases for adjusting backset between limits of said relative movement and to all of infinite backset positions therebetween, cooperating means on said link, bolt and front case for holding said bolt in a fully extended position, resisting inward movement of said bolt except by turning of said swivel, at either limit of backset adjustment and at all backset adjustment positions therebetween.

16. The adjustable backset door latch of claim 15 characterized in that the cooperating means includes a slot in said bolt, a slot in said front case, with said link projecting through said bolt slot and into said front case slot when said bolt is in a fully extended position.

17. The adjustable backset door latch of claim 16 characterized in that said link is connected to said bolt by a pin, said pin being movable in said bolt slot.

18. The adjustable backset door latch of claim 17 characterized in that said bolt slot has a size and shape permitting translational movement of said link relative to said bolt and pivotal movement of said link relative to said bolt.

19. An adjustable backset door latch having a case assembly including a front case and a rear case telescopically movable relative thereto, a bolt movable in said case assembly between an extended position in which the bolt extends a determined distance forwardly of said front case and a retracted position in which said bolt is within said case assembly, a swivel mounted in said rear case for turning movement, a link connecting said swivel and bolt whereby turning movement of said swivel moves said bolt between said extended and retracted positions, means limiting relative movement of said front and rear cases for adjusting backset between limits of said relative movement, cooperating means on said link, bolt and front case for holding said bolt in a fully extended position, resisting inward movement of said bolt except by turning of said swivel, at either limit of backset adjustment.

20. The adjustable backset door latch of claim 19 characterized in that the cooperating means includes a slot in said bolt, a slot in said front case, with said link projecting through said bolt slot and into said front case slot when said bolt is in a fully extended position.

21. The adjustable backset door latch of claim 20 characterized in that said link is connected to said bolt by a pin, said pin being movable in said bolt slot.

22. The adjustable backset door latch of claim 21 characterized in that said bolt slot has a size and shape permitting translational movement of said link relative to said bolt and pivotal movement of said link relative to said bolt.

* * * * *